US010945498B2

(12) United States Patent
Williams

(10) Patent No.: US 10,945,498 B2
(45) Date of Patent: Mar. 16, 2021

(54) DEVICE WITH A ASSISTED OPENING AND CLOSING MECHANISM

(71) Applicant: Paul Derrick Williams, Silkstone (AU)

(72) Inventor: Paul Derrick Williams, Silkstone (AU)

( * ) Notice: Subject to any disclaimer, the term of this patent is extended or adjusted under 35 U.S.C. 154(b) by 362 days.

(21) Appl. No.: 16/035,588

(22) Filed: Jul. 14, 2018

(65) Prior Publication Data

US 2019/0014870 A1 Jan. 17, 2019

Related U.S. Application Data

(60) Provisional application No. 62/533,114, filed on Jul. 16, 2017.

(51) Int. Cl.

| | |
|---|---|
| ***A44C 9/00*** | (2006.01) |
| ***G08B 15/00*** | (2006.01) |
| ***B26B 27/00*** | (2006.01) |
| ***B26B 21/52*** | (2006.01) |
| *B26B 1/08* | (2006.01) |

(52) U.S. Cl.

CPC ..... *A44C 9/0061* (2013.01); *A44C 9/0069* (2013.01); *B26B 21/527* (2013.01); *B26B 27/00* (2013.01); *B26B 27/007* (2013.01); *G08B 15/001* (2013.01); *G08B 15/004* (2013.01); *B26B 1/08* (2013.01)

(58) Field of Classification Search

CPC ..... B26B 1/08; B26B 21/527; B26B 27/00; B26B 27/007; A44C 9/0061; A44C 9/0069; G08B 15/001; G08B 15/004

See application file for complete search history.

(56) References Cited

U.S. PATENT DOCUMENTS

| | | | | |
|---|---|---|---|---|
| 1,260,827 | A * | 3/1918 | Stefanov | F41C 27/18 42/86 |
| 5,398,524 | A * | 3/1995 | Rochez | A44C 9/0053 63/1.12 |
| 5,588,214 | A * | 12/1996 | Nelson | B26B 27/007 30/298 |
| 2005/0193565 | A1* | 9/2005 | Knowles | B26B 27/007 30/155 |
| 2010/0251552 | A1* | 10/2010 | Gazcon | B26B 1/08 30/162 |
| 2011/0077060 | A1* | 3/2011 | Shi | B26B 11/00 455/575.1 |
| 2015/0239135 | A1* | 8/2015 | Chu | B26B 1/08 30/162 |
| 2017/0115092 | A1* | 4/2017 | Holmes, Sr. | F41B 15/00 |
| 2017/0334084 | A1* | 11/2017 | Hogg | B26B 27/007 |

* cited by examiner

*Primary Examiner* — Ryan A Reis

(57) ABSTRACT

Embodiments, alternatives and variations of a device with a assisted opening and closing mechanism for the opening and closing of at least one shaft. Finger rings and other items is configured with components to conveniently, easily and quickly open and close at least one shaft with at least one tensioning mechanism. Other uses of said devices comprise use as a knife, as a tool, a way of relaxation, for therapeutic use, for educational use, as a toy, for self defence, and for entertainment purposes.

19 Claims, 13 Drawing Sheets

DEVICE WITH A ASSISTED OPENING AND CLOSING MECHANISM

CROSS-REFERENCE TO RELATED APPLICATIONS

This application claims priority to and the benefit of U.S. Provisional Application Ser. No. 62/533,114 which was filed on Jul. 16, 2017.

TECHNICAL FIELD

Embodiments of the invention relates to jewelry, specifically to rings comprising an assisted opening and closing mechanism for the opening and closing of at least one shaft. And to other devices such as automatic knives and gadgets comprising an assisted opening and closing mechanism for the opening and closing of at least one shaft.

BACKGROUND OF THE INVENTION

Jewelry items such as finger rings are mostly worn for decorative purposes. Some finger rings are also worn for self defence, novelty value, and other purposes. Movable or fixed components are embodied in finger rings to use for self defence, or as a tool, etc. Some of these finger rings lack cosmetic appeal. Some lack ease of use, and some lack both.

Automatic knives using spring tension for opening and closing the blade is commonly used. They are held in the hand during use and stored in pockets, handbags etc after use. There is a need for an improved automatic self defence device(s) that is more convenient to use, more compact, and more quickly accessible.

Some attempts have been made to adapt a finger ring with a component(s) for self defence purposes as an alternative to carrying a knife, pepper spray and other self defence gadgets. Some of these finger rings may also be used for other purposes such as cutting string and wire, or as a simple tool such as a screwdriver. A finger ring embodied with these components is convenient but many look bulky, cosmetically unappealing and too obvious for their intended use.

Some attempts have been made to overcome these problems. For example, U.S. Pat. No. 5,301,432A (Richardson & Richardson) describes a ring for cutting or defensive purposes. The described pin mechanism is a means for pivoting the blade from a retracted position. The pin mechanism is used to open and close the blade. But due to the fixed design the cosmetic appeal is limited and the ring is bulky. In an emergency situation it also takes too much time to open and close the knife in the ring.

U.S. Pat. No. 3,748,371 (Petrosky) describes a finger ring designed for defensive purposes. The cosmetic appeal is limited, the design is bulky and it's too obvious that the ring is for defensive purposes. The stabilizing wings are not retractable and they could accidentally catch on various items causing unintentional damage.

U.S. patent Ser. No. 11/999,288 (McHenry & Ingram) describes an automatic opening and closing knife. This is an out the front knife where a single trigger is used to open and close the blade under spring tension. This automatic knife and other types of automatic knives are generally kept in your pocket or somewhere else. But not everyone wants to carry this and other types of automatic knives in their pocket or handbag etc. In this way they are inconvenient and may be difficult to access quickly for emergency use.

All of these teachings demonstrate limitations that embodiments of the herein invention overcomes. The embodiments of this invention describes alternatives comprising but not limited to being cosmetically appealing, convenient to use, quick to access, and with simpler and faster deployment mechanisms.

SUMMARY OF THE INVENTION

The following presents a simplified summary of the invention in order to provide a basic understanding of some aspects of the invention. It is intended to neither identify all the elements and configurations of the invention nor delineate the scope of the invention. Its purpose is to present some concepts of the invention in a simplified form as to preclude the more detailed description that is presented later.

An object of the invention is to provide embodiments, variations and alternatives of a device for the assisted opening and closing of at least one moveable shaft. The various embodiments, variations and alternatives keep within the scope of the invention, and show various ways the invention can be expressed, embodied and used.

Another object of the invention is to provide the embodiments, variations and alternatives of a device for use as a way of relaxation, for therapeutic use, for educational use, as a toy, as a tool, for self defence, and for entertainment purposes.

Another object of the invention is to provide the embodiments, variations and alternatives of a device to be adapted for use as automatic knives and other self defence devices.

BRIEF DESCRIPTION OF THE DRAWINGS

Embodiments of the invention will now be described with reference to the attached drawings, wherein like reference numerals are used to refer to like elements throughout.

First Embodiment

Structure

Figure 12:
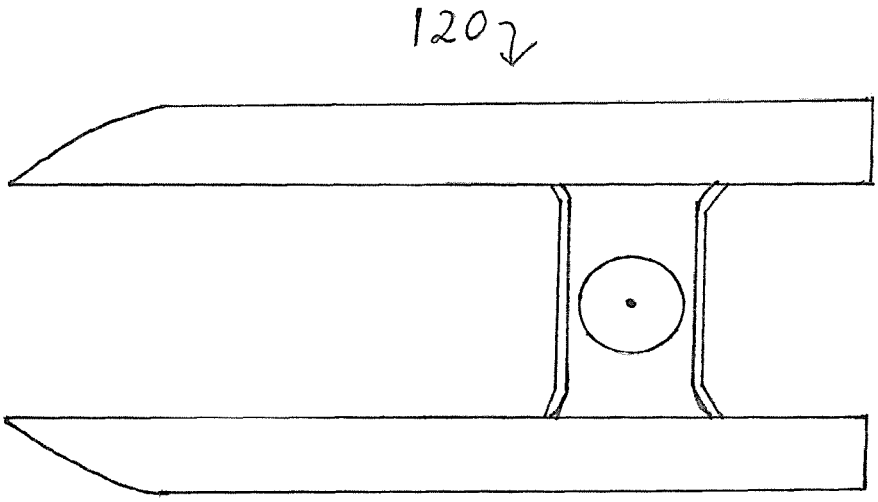
FIG. 12 shows an aerial view of an example of an embodiment of a shaft.
Figure 13:
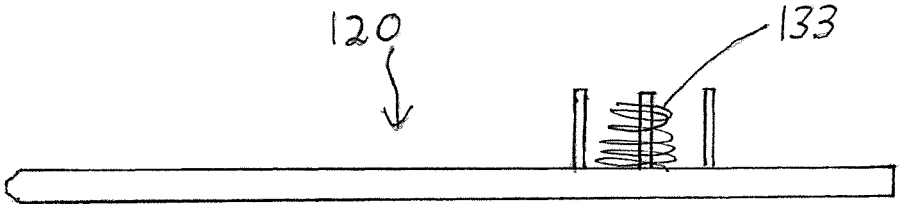
FIG. 13 shows a side view of an example of an embodiment of a shaft with an elastic device configured adjacent to switch mechanism.

Referring now to the drawings, where FIGS. 1-11 shows a first embodiment of a device with an assisted opening and closing mechanism 100, (first embodiment 100). FIGS. 12 and 13 shows an alternative configuration of a shaft 120 that may be configured in embodiment 100 and other embodiments, variations and alternatives.

FIGS. 1-11 shows the first embodiment 100, a wearable ring assembly, comprising a chamber 101, and a shaft 102, and an elastic device 103, and a switch mechanism 104.

Figure 8:
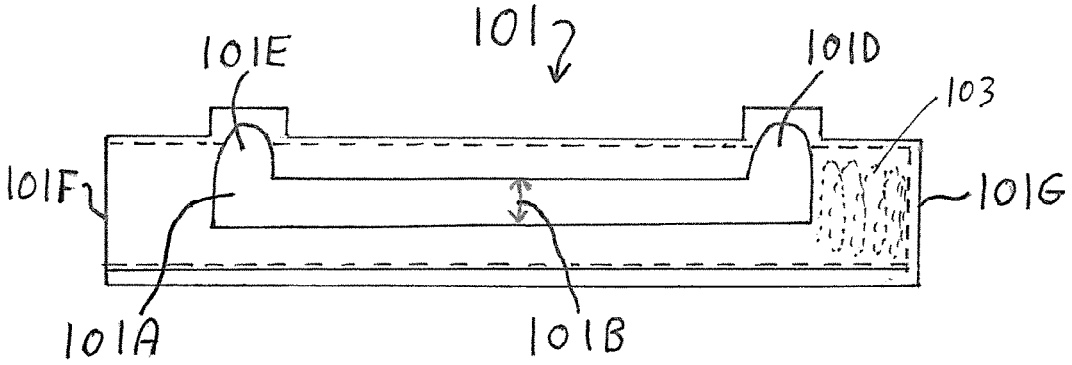
FIG. 8 shows a side view of components of the chamber and an elastic device.
Figure 9:
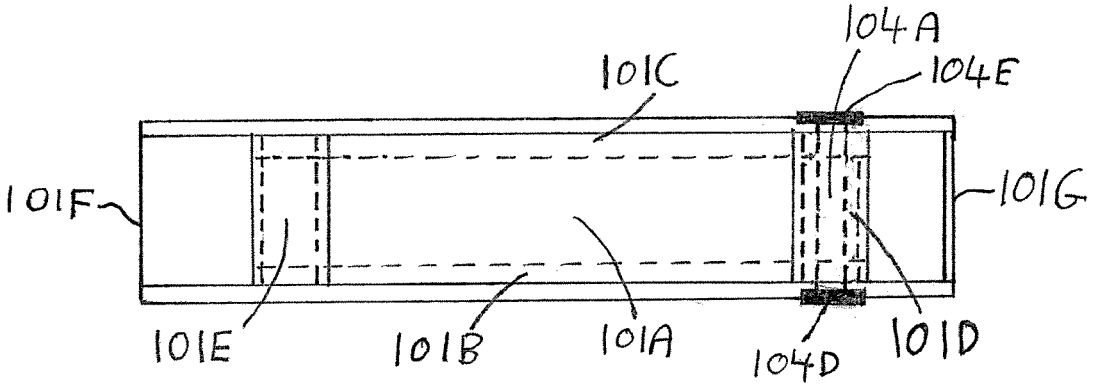
FIG. 9 shows an aerial view of the chamber with the switch mechanism in the closed position.

As shown in FIGS. 8-9, the chamber 101 further comprises a bore 101*a*; and slide cavities 101*b* and 101*c*; and holding cavities 101*d* and 101*e*; an open end 101*f* and a closed end 101*g*.

As shown in FIGS. 2,3,5,6 and 11 the substantially cylindrical shaft 102 further comprises a bore 102*a* with an internally threaded distal end 102*b*; and a cavity portion 102*c*; and a closed end 102*d*; and a tool portion 102*e* with an eternally threaded end 102*f* and a pointed end 102*g*; and a piston 102*h* with a flat end portion 102*i* and an angled end portion 102*j*; and an elastic device 102*k*.

Figure 7:
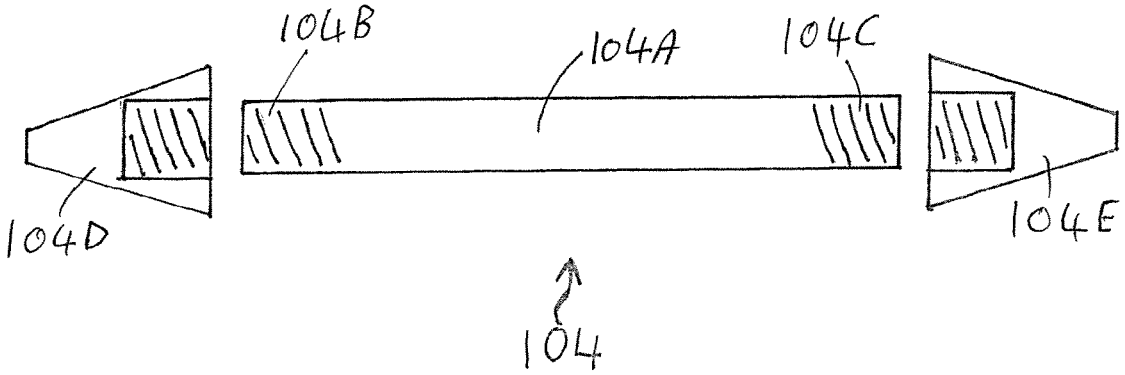
FIG. 7 shows components of a switch mechanism.

As shown in FIG. 7 the switch mechanism 104 comprises a first portion 104*a* with a first threaded end 104*b* and a second threaded end 104*c*; and an internally threaded second portion 104*d*; and an internally threaded third portion 104*e*.

Connection

Assembling the Projectile

Figure 1:
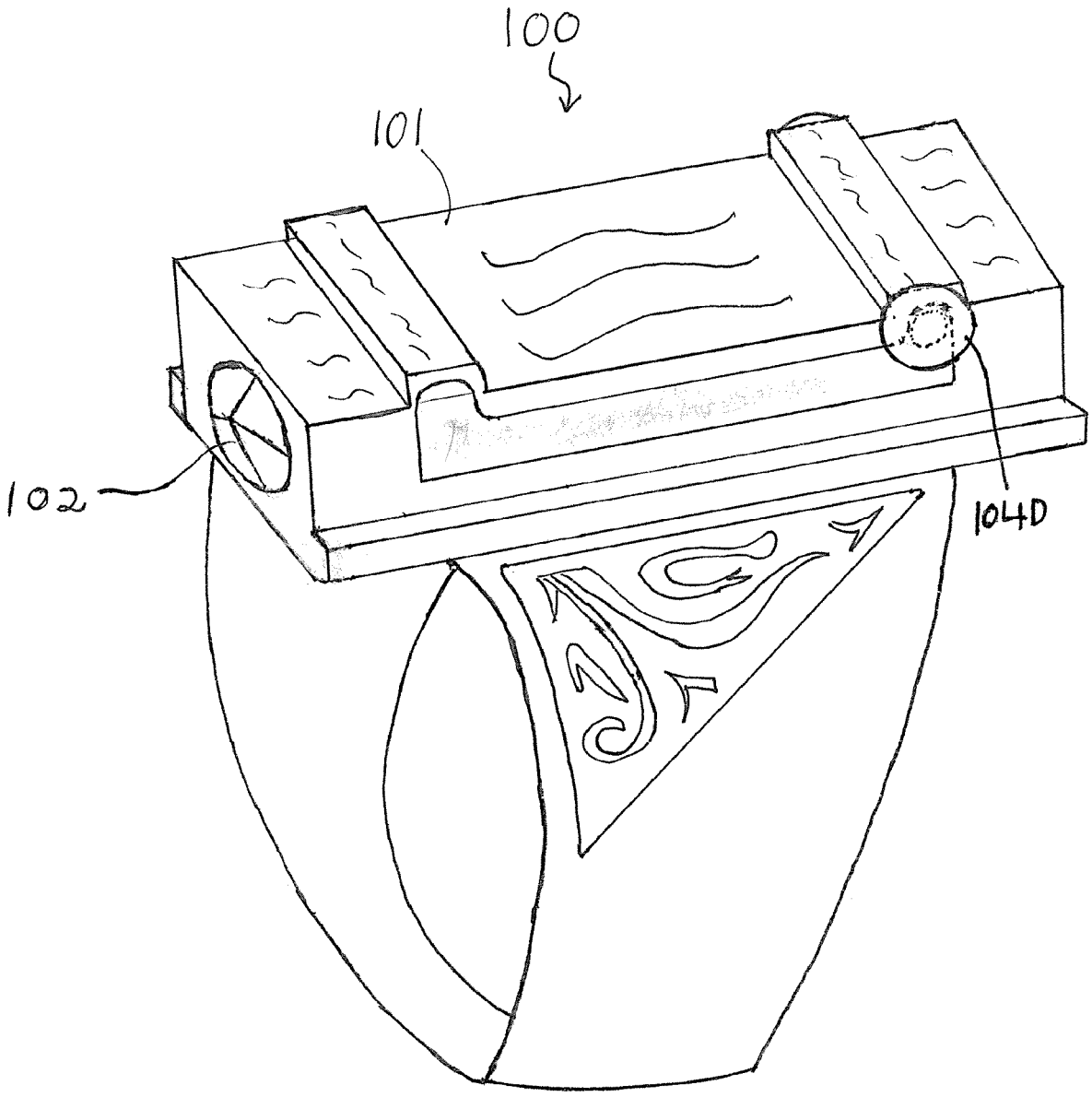
FIG. 1 shows a general isometric view of embodiment 100, highlighting some components.
Figure 2:
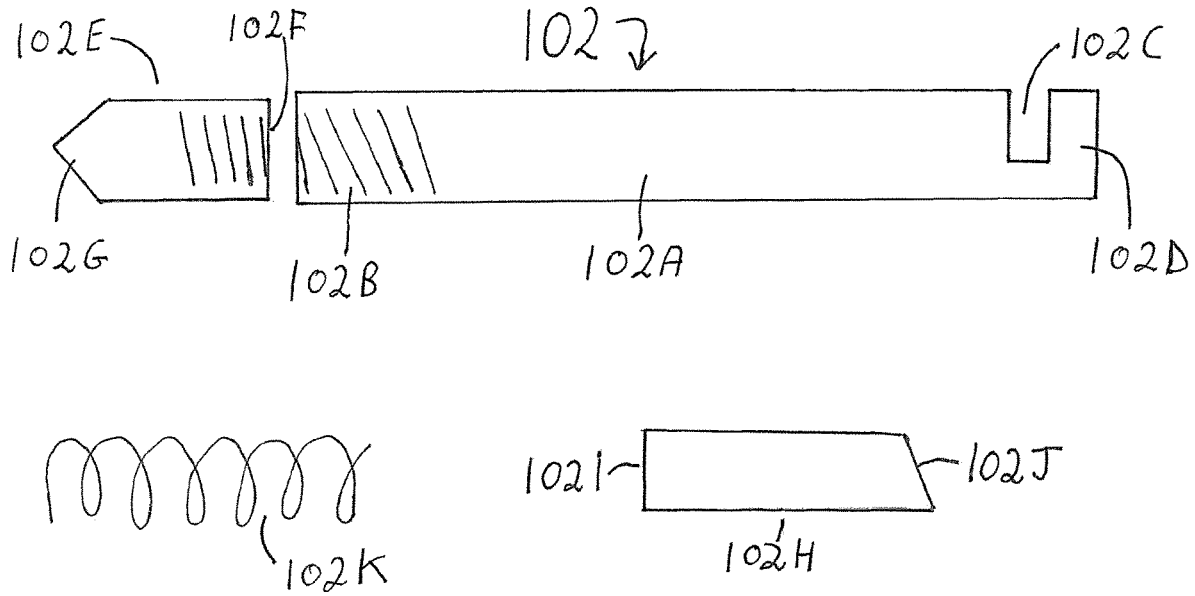
FIG. 2 shows a view of a dismantled shaft and components it comprises.
Figure 3:
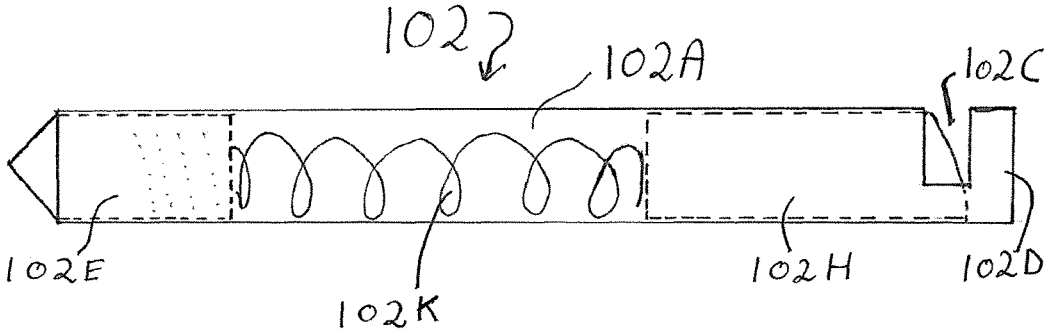
FIG. 3 shows a view of an assembled shaft and components it comprises.
Figure 4:
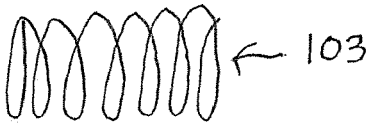
FIG. 4 shows an elastic device.
Figure 5:
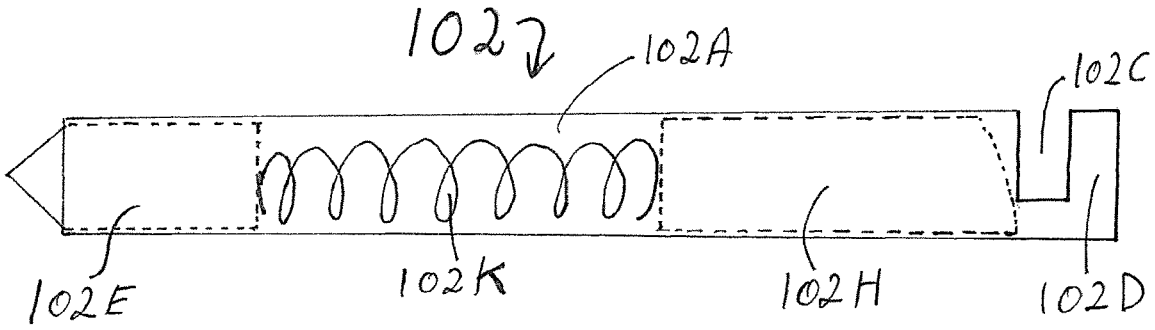
FIG. 5 shows an assembled shaft with the piston component inside the bore of shaft.
Figure 6:
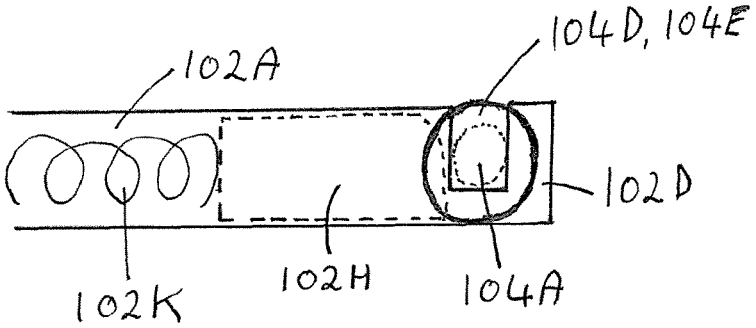
FIG. 6 shows a partial view of an assembled shaft with the piston component inside the bore of shaft with the switch mechanism applying force to piston.

As shown in FIGS. 2, 3 and 5, shaft 102 is assembled by placing piston 102*h* inside bore 102*a* through the opening at the internally threaded distal end 102*b*. The angled end portion 102*j* of piston 102*h* is inserted first. Then the elastic device 102*k* is inserted behind flat end portion 102*i* of piston 102*h*.

The externally threaded end portion 102*f* of tool portion 102*e* is then screwed into the internally threaded end portion 102*b* to prevent dislodgment of elastic device 102*k* and piston 102*h*. The angled end portion 102*j* of piston 102*h* protrudes into cavity portion 102*c* and rests against closed end 102*d*. The flat end portion 102*i* and main body of piston 102*h*, remains inside bore 102*a*.

The inserted tool portion 102*e* is tensioned against elastic device 102*k* which in turn is tensioned against flat end portion 102*i* of piston 102*h*; the said tension forces the angled end portion 102*j* of piston 102*h* against flat end portion 102*d*.

Inserting Assembled Projectile to Chamber

Figure 10:
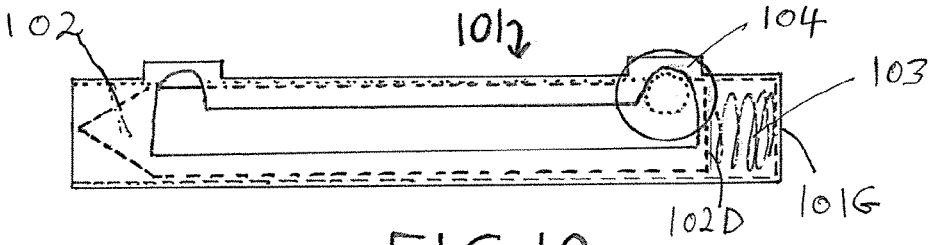
FIG. 10 shows a side view of the chamber with an elastic device, a shaft and a switch mechanism.
Figure 11:
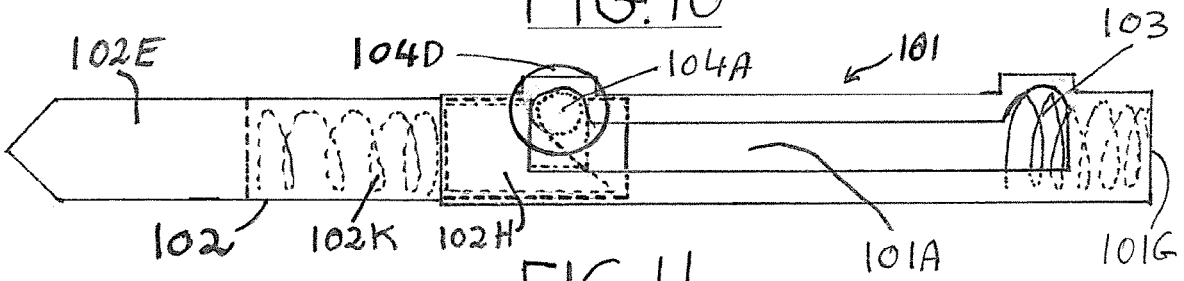
FIG. 11 shows a chamber with the shaft in the open position; and an elastic device, and a switch mechanism.

As shown in FIGS. 8, 10 and 11 the elastic device 103 is inserted into bore 101*a* of chamber 101 and can move back and forth as it frictionally contacts the bore 101*a*.

The assembled shaft 102 is then inserted into the bore 101*a* of chamber 101. The closed end 102*d* of shaft 102 is inserted first and shaft 102 can slide back and forth inside bore 101*a* with frictional contact. When tension is applied from the closed end 102*d* of shaft 102 to the elastic device 103 which it frictionally engages, the elastic device 103 is compressed and forced against the closed end 101*g* of chamber 101.

When elastic device 103 is substantially compressed it is disposed between closed end 101*g* of chamber 101 closed end 102*d* of projectile 102; and the cavity portion 102*c* of shaft 102 is adjacent to the holding cavity 101*d* of chamber 101.

The first component 104*a* of switch mechanism 104 is then inserted through holding cavity 101*d* of chamber 101, and through cavity portion 102*c* of shaft 102, where first component 104*a* frictionally engages the holding cavity 101*d* and the cavity portion 102*c* and the angled end portion 102*j* of piston 102*h*.

The internally threaded second component 104*d* of switch mechanism 104 is then screwed on to externally threaded portion 104*b* of first component 104*a*, and the internally threaded third component 104*e* of switch mechanism 104 is then screwed on to externally threaded portion 104*c* of first component 104*a*.

The assembled switch mechanism 104 moves freely when manipulated by user but does not accidentally dislodge through the cavity portion 102*c* of shaft 102; and through the holding cavities 101*d* and 101*e*; and through the slide cavities 101*b* and 101*c*, when fully assembled as explained.

Operation/Function

FIG. 10 shows the shaft 102 in the closed position, enclosed inside chamber 101 and held in place by switch mechanism 104 in holding cavity 101*d* (see FIG. 8). FIG. 11 shows the shaft 102 in the open position, with a substantial portion of the shaft 102 protruding outside bore 101*a* of chamber 101. In the open position, the shaft 102 is held in place by switch mechanism 104 in holding cavity 101*e* (see FIG. 8).

If the shaft 102 of first embodiment 100 is in the closed position and a user wants the shaft 102 to be in the open position, the user simultaneously applies downwards force using a finger(s) or a simple tool, to the protruding second component 104*d* and the third component 104*e* of switch mechanism 104.

The substantially cylindrical first component 104*a* of switch mechanism 104 in turn applies downwards force to the angled end portion 102*j* of piston 102*h*. The said downwards force on the angled end portion 102*j* of piston 102*h*, forces the piston 102*h*, tensioned by the elastic device 102*k*, towards the distal end of bore 102*a* of shaft 102.

The switch mechanism 104 is now released from the holding cavity 101*d*, as the user maintains downwards force on switch mechanism 104 as explained. The switch mechanism 104 is now also adjacent to slide cavities 101*b* and 101*c* and the tension supplied by the elastic device 103, forces the shaft 102 and the switch mechanism 104 towards the distal end of bore 101*a* of chamber 101.

When the switch mechanism 104 is adjacent to holding cavity 101*e*, the continuing spring tension placed on the piston 102*h* forces the first component 104*a* of switch mechanism 104 into the holding cavity 101*e*. The shaft 102 is now securely held in the open position until released by user and placed back into the closed position.

To move the shaft 102 back into the closed position, the user applies downwards force using a finger(s) or a simple tool, to the second component 104*d* and the third component 104*e* of switch mechanism 104. When the switch mechanism 104 is adjacent to slide cavities 101*b* and 101*c*, the user pushes switch mechanism 104 and shaft 102, towards the closed end 101*g* of chamber 101.

When switch mechanism 104 is adjacent to holding cavity 101*d*, the continuing tension from the piston 102*h* forces the first component 104*a* of switch mechanism 104 into holding cavity 101*d*. The shaft 102 is now in the closed position until released by user and placed back into the open position.

Alternatives and Variations

The first embodiment 100 is only one of many ways that the invention can be configured and customized without departing from the scope of the invention. Configurations, style, appearance and customization will depend on factors including but not limited to the gender of the wearer, style requirements, size requirements, etc.

Other ways in which the invention can be configured and embodied is outlined below, but is by no means limiting because it is not possible to outline all the many different embodiments and configurations within the scope of the invention. All components can be configured in different ways such as different shapes, sizes and dimension to perform the same function/operation. For example:

In first embodiment 100, the elastic device 103 is a compression spring but in other embodiments any suitable type of elastic device 103 or tensioning mechanism can be utilized. The chamber 101, bore 101*a*, and other said components even if not specifically listed, may be any different shape, size, style, configurations and dimension as required and may be configured to comprise the shaft 120 as shown in FIGS. 12 and 13, or any other said shaft configuration.

The shaft 102 may be any different shape, size, style and dimension as required, such as a said shaft with multiple tool portions 102, etc. FIGS. 12 and 13 shows an aerial and side view respectively, of non-limiting example of how a shaft 120, in this example a substantially flat said shaft 120, can be configured.

Embodiment #2

Structure

Referring now to the drawings, where FIGS. 14-22, shows a second embodiment of a device with an assisted opening and closing mechanism 200, (second embodiment 200). Some components in embodiment 200 are in embodiment 100 so only the differences in the said embodiment's structure, connection, and operation/function will be significantly outlined. The shaft 202 for example, has the same internal components, such as the said piston and said elastic device as explained in embodiment 100, although different configurations may be utilized.

FIGS. 14-22 shows the second embodiment 200, a wearable ring assembly, comprising a chamber 201, and a shaft 202, and elastic devices 203*a* and 203*b*, and a switch mechanism 204.

Figure 14:
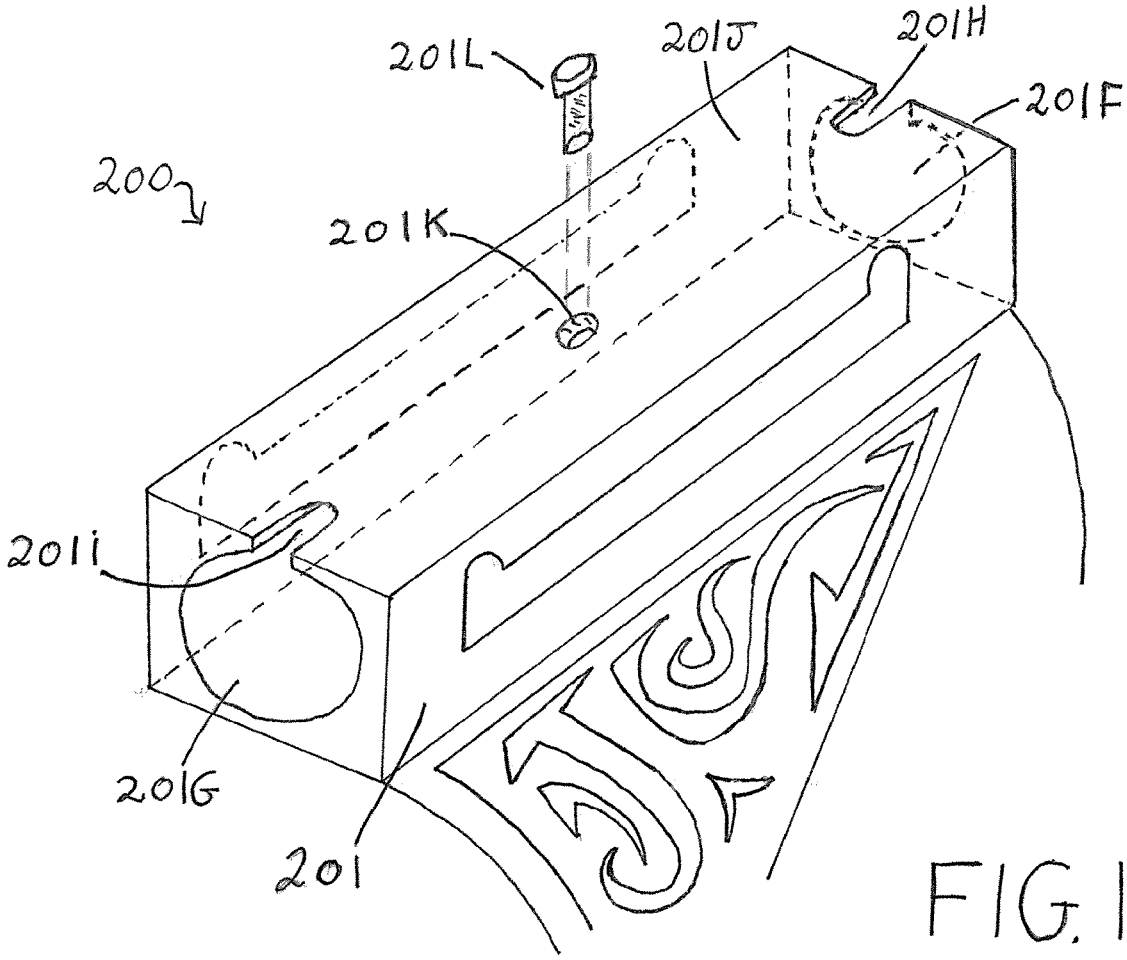
FIG. 14 shows a partial isometric first view of the second embodiment 200 with different components.
Figure 15:
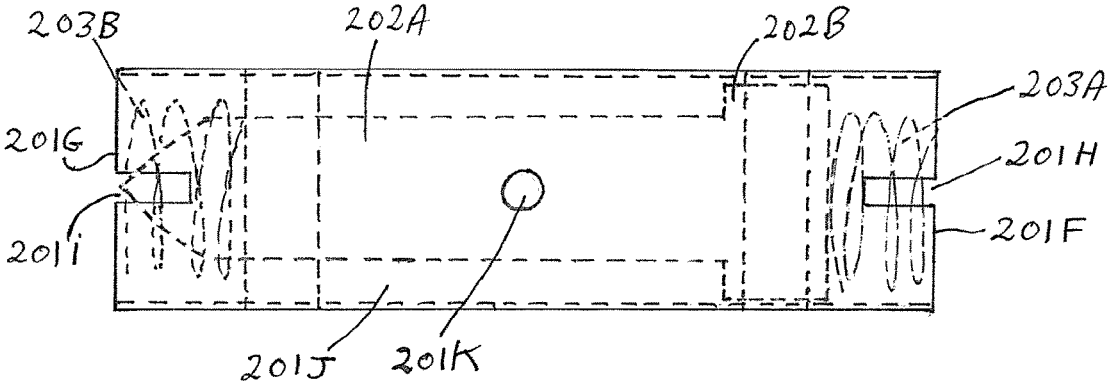
FIG. 15 shows an aerial view of the chamber of the second embodiment configured with some internal components.

As shown in FIG. 14 the chamber 201 further comprises a first open end 201*f* and a second open end 201*g*; and a first slide portion 201*h* and a second slide portion 201*i*; and a top portion 201*j*; and a internally threaded socket portion 201*k*; and a releasably connected threaded slide holder 2011.

The second embodiment 200 comprises a double action configuration for placing the shaft 202 (FIG. 17) into the said open and closed positions when manipulated by user. When used in conjunction with switch mechanism 204 (FIGS. 18, 19, 20 and 21); elastic device 203*a* assists placing the said shaft in the open position, and elastic device 203*b* assists placing the said shaft in the closed position.

Figure 16:
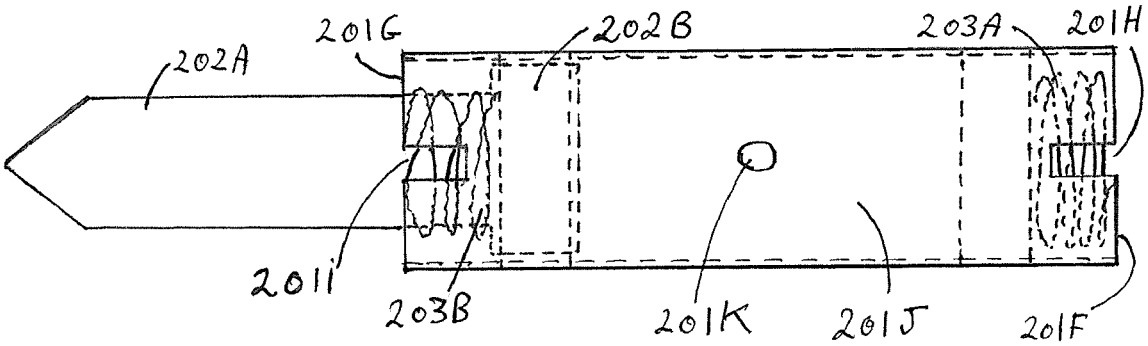
FIG. 16 shows an aerial view of the shaft in the open position.
Figure 17:
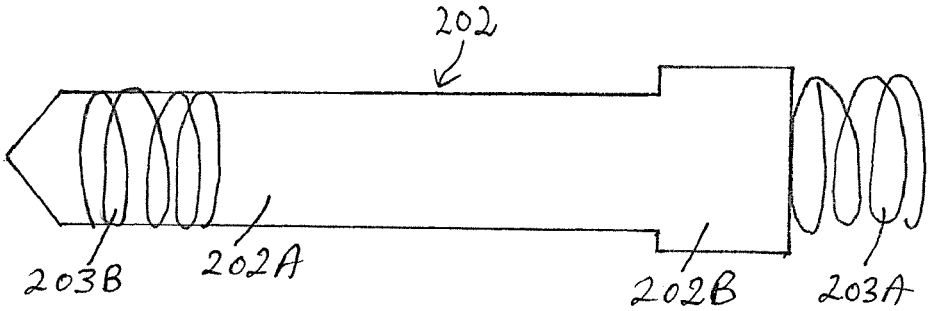
FIG. 17 shows an example of how a shaft can be configured with elastic devices for opening and closing.

The shaft 202 in this embodiment comprises a narrower distal end portion 202*a* as shown in FIGS. 16 and 17.

Figure 18:
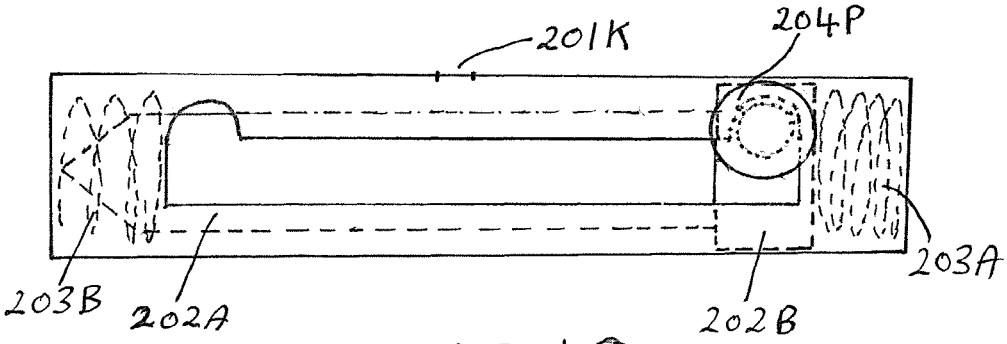
FIG. 18 shows a side view of the shaft in the closed position and side view of some components of the switch mechanism.
Figure 19:
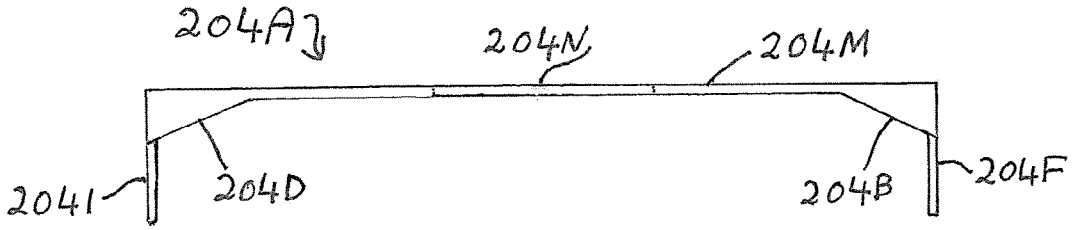
FIG. 19 shows a side view of the body portion of the switch mechanism.
Figure 20:
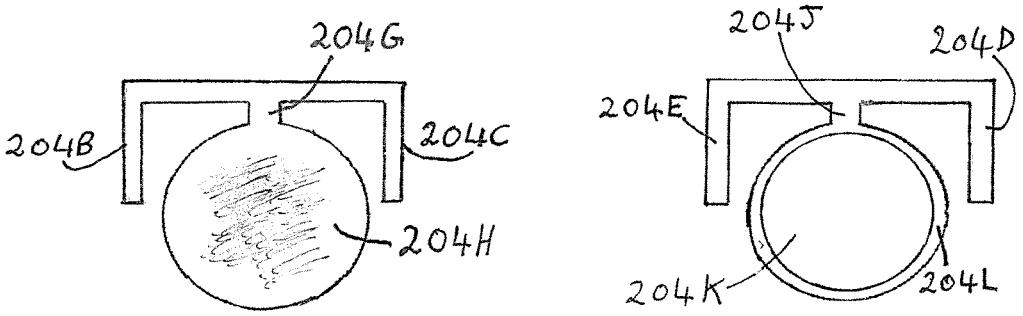
FIG. 20 shows different end views of the body portion of the switch mechanism.
Figure 21:
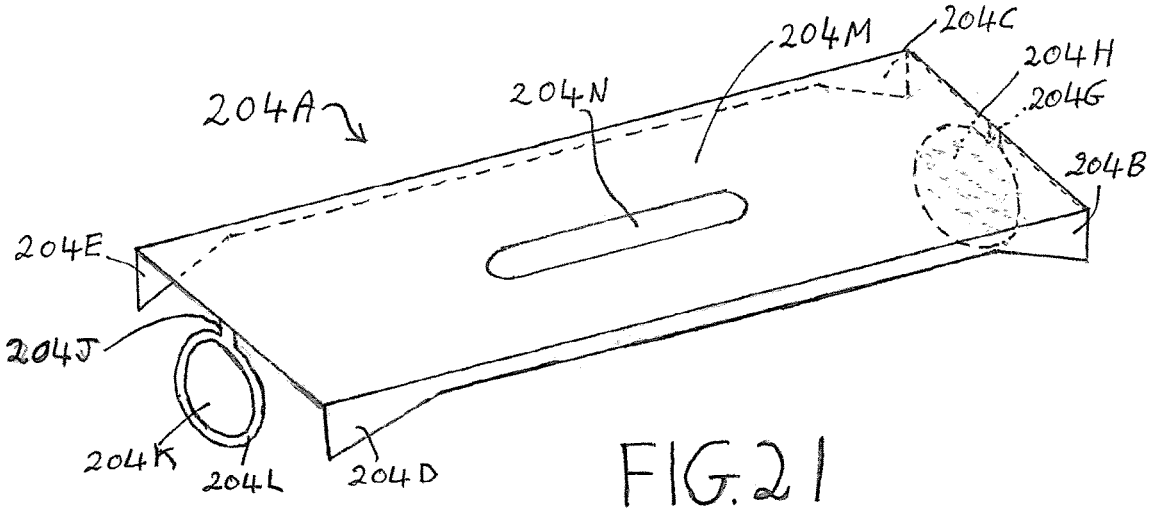
FIG. 21 shows an isometric view of the body portion of the switch mechanism.
Figure 22:
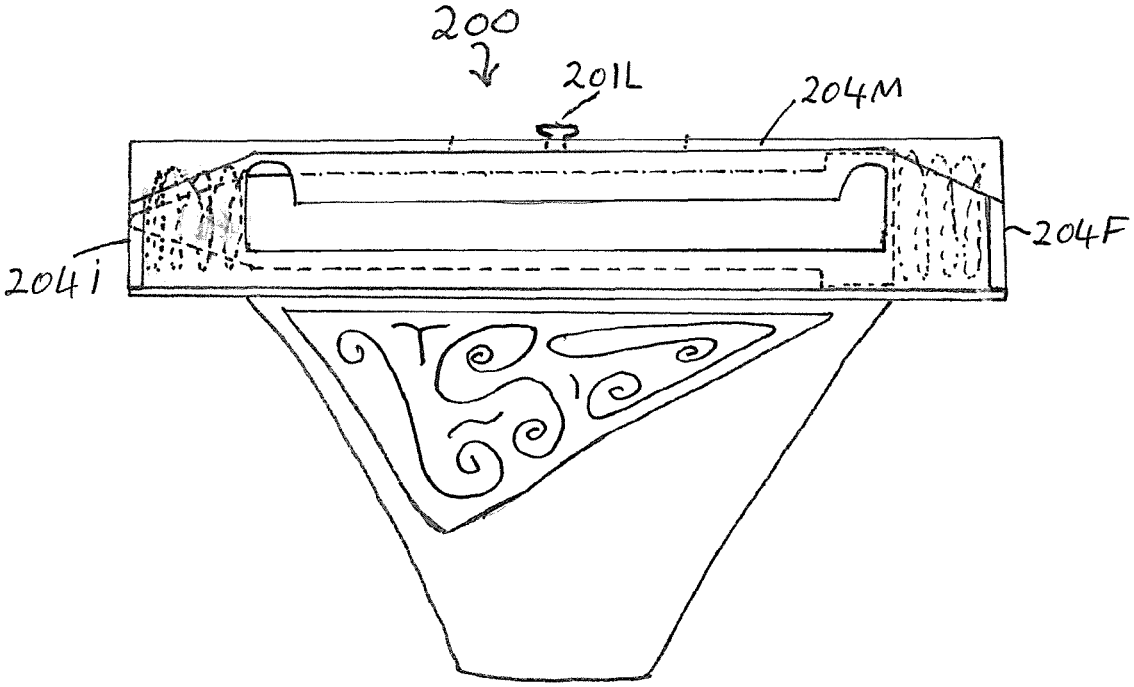
FIG. 22 shows a side view of the wearable ring assembly, embodiment 200, with the shaft in the closed position.

The switch mechanism 204 in this embodiment comprises a body portion 204*a*, and a second component 204*p* (FIG. 18). As shown in FIGS. 19-21 the body portion 204*a* further comprises a first angled portion 204*b*, and a second angled portion 204*c*, and a third angled portion 204*d*, and a fourth angled portion 204*e*; and a first tensioning portion 204*f*, and a second tensioning portion 204*i*; and a top portion 204*m*, and a socket portion 204*n*.

As shown in FIG. 20 the first tensioning portion 204*f* further comprises a gap slider 204*g* and a pushing portion 204*h*. The second tensioning portion 204*i* further comprises a gap slider 204*j* and a socket portion 204*k* and a pushing portion 204*l*.

Connection

The shaft 202 is disposed inside the said bore, and elastic device 203*a* is inserted through first open end 201*f* of chamber 201, and placed behind said closed end of shaft 202. Elastic device 203*b* is inserted through second open end 201*g* and placed around narrower distal portion 202*a* of shaft 202.

The body portion 204*a* of switch mechanism 204 is placed on top portion 201*j* of chamber 201 so that body portion 204*a* can slide back and forth on top portion 201*j* of chamber 201 when manipulated by user.

The releasably connected threaded slide holder 2011 passes through socket portion 204*n* of body portion 204*a* and is screwed into internally threaded socket portion 201*k* of chamber 201; to prevent movable body portion 204*a* from dislodging. The movable body portion 204*a* can freely slide back and forth when manipulated by user, but is prevented from dislodgement because the threaded slide holder 2011 prevents both the accidental dislodgment, and the distance of back and forth movement of body portion 204*a*. The second component 204*p* of switch mechanism 204 is releasably connected as previously shown in embodiment 100. The connected ring assembly 200 is now ready to wear and use.

Operation/Function

Using a finger or a tool, the user applies forward tension to top portion 204*m* of body portion 204*a* of switch mechanism 204, pushing it towards the distal end of chamber 201. First tensioning portion 204*f* of moving body portion 204*a*, applies tension to elastic device 203*a* which in turn applies tension to said flat end portion of shaft 202.

Because shaft 202 is held in position in said holding cavity at proximal end of chamber 201 by second component 204*p* (FIG. 18) of switch mechanism 204, the shaft 202 does not move out of position despite said applied spring tension from elastic device 203*a*.

As explained in the first embodiment 100, the second component 204*p* of switch mechanism 204 is continuously forced into the upwards position into said holding cavity because of said spring tension applied by said components of shaft 202.

A function of body portion 204*a* of switch mechanism 204 is to release shaft 202 from being held in position by second component 204*p* of switch mechanism 204.

As said, when the body portion 204*a* is pushed towards the distal end of chamber 201, the first tensioning portion 204*f* applies tension to elastic device 203*a* and compresses elastic device 203*a* against said closed end of shaft 202.

Also, when the body portion 204*a* is pushed towards the distal end of chamber 201, the first angled portion 204*b* and second angled portion 204*c* simultaneously contacts the second component 204*p* of switch mechanism 204.

The said angled portions 204*b* and 204*c* forces the second component 204*p* of switch mechanism 204 downwards and adjacent to said slide cavities of chamber 201. The second component 204*p* of switch mechanism 204 is now released from said holding cavity. In that position, the said spring tension from compressed elastic device 203*a* forces shaft 202 through said bore of chamber 201 towards distal end of chamber 201.

The timing of the first angled portion 204*b* and second angled portion 204*c* releasing second component 204*p* of switch mechanism 204 from said holding cavity is such that it is timed with the substantial compression of elastic device 203*a*. So that when elastic device 203*a* is at a substantial compression (enough to force shaft 202 under spring tension to distal end of chamber 201), against said closed end of shaft 202, the second component 204*p* of switch mechanism 204 is released from said holding cavity so that the spring tension from elastic device 203*a*, forces shaft 202 down said bore towards said distal end of chamber 201 with substantial force.

The narrower distal end 202*a* of shaft 202 passes through elastic device 203*b* and through concave portion 204*k* of second tensioning portion 204*i*. Shaft 202 is now held in place in said holding cavity at distal end of chamber 201 and is in the said open position when second component 204*p* of switch mechanism 204 is held in position as explained in embodiment 100.

To return shaft 202 to proximal end in the closed position, the user applies force using a finger or a simple tool and completes the same said steps in reverse. However, in the said open position, the concave portion 204*k* and the pushing portion 204*l* and the elastic device 203*b* is adjacent to the portion of the narrower distal end 202*a* of shaft 202 that remains inside said bore of chamber 201.

As user pushes body portion 204*a* back towards proximal end of chamber 201, the concave portion 204*k* slides around the narrower distal end 202*a* of shaft 202 as the pushing portion 204*l* compresses elastic device 203*b* against wider portion 202*b* of shaft 202. As explained in the process of placing the shaft 202 in the open position, the angled portions 204*d* and 204*e* releases the second component 204*p* of switch mechanism 204 from said holding cavity and adjacent to said slide cavities, so that shaft 202 can return to proximal end closed position through said bore of chamber 201 and be locked into said holding cavity at proximal end.

Alternatives and Variations

The second embodiment 200 is only one of many ways that the invention can be configured and customized without departing from the scope of the invention. In a non-limiting example, it is to be understood that in alternative embodiments that multiple switch mechanisms may be configured instead of a single switch mechanism and can be configured in many different ways to perform the same basic function.

Configurations, style, appearance and customization will depend on factors including but not limited to the gender of the wearer, style requirements, size requirements, etc. Other ways in which the invention can be configured and embodied is outlined below, but is by no means limiting because it is not possible to outline all the many different embodiments and configurations within the scope of the invention.

All components can be configured in different ways such as different shapes, sizes, angles, and dimensions to perform the same function/operation. For example:

In the second embodiment 200, the elastic device 203*a* and 203*b* is a compression spring but in other embodiments any suitable type of said elastic devices or tensioning mechanisms can be utilized. The chamber 201, said bore, and other said components even if not specifically listed, may be any different shape, size, style, configuration and dimension as required.

The shaft 202 may be any different shape, size, style and dimension as required such as a said shaft with multiple tool portions 202, etc. FIGS. 12 and 13 show a non-limiting example of how a substantially flat said shaft can be configured. The chamber 201, said bore, and other said components even if not specifically listed, may be any different shape, size, style, configuration and dimension as required.

Embodiment #3

Referring now to the drawings, where FIGS. 23-31, shows a third embodiment of a device with an assisted opening and closing mechanism 300, (the third embodiment 300). Some components in embodiment 300 is in previous said embodiments so only the differences in this said embodiment's structure, connection, and operation/function will be significantly outlined.

Structure and Connection

FIGS. 23-31 shows the third embodiment 300, a wearable ring assembly (some drawings are partial because of explanation in other embodiments); comprising a chamber 301, and a shaft 302, and an elastic device 303, and a switch mechanism 304.

Switch Mechanism

Figure 23:
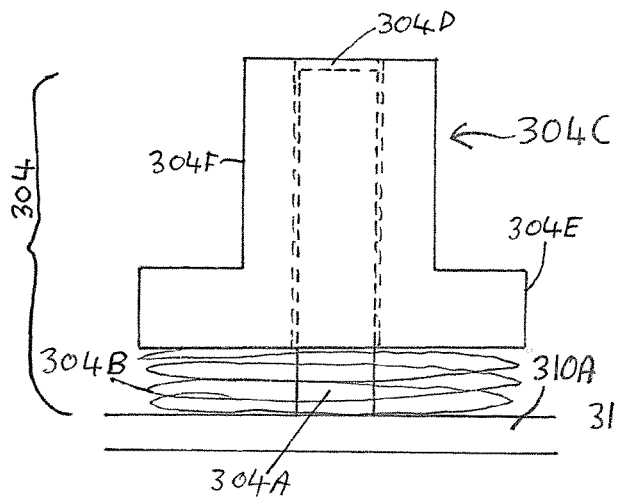
FIG. 23 shows the pusher component of the switch mechanism of the third embodiment 300 when applying compressive tension to the elastic device component of switch mechanism.
Figure 24:
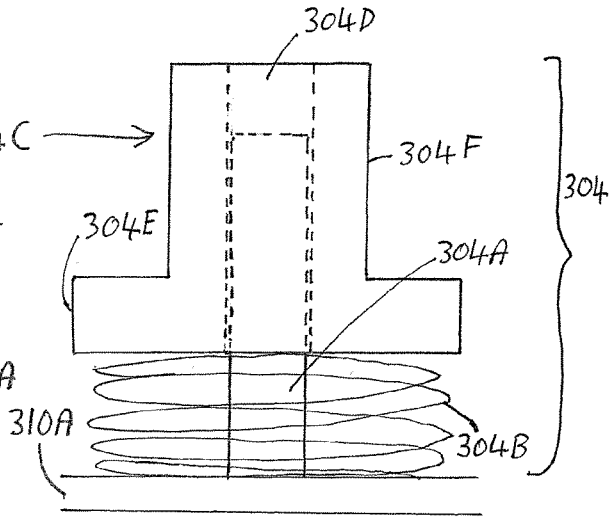
FIG. 24 shows the pusher component of the switch mechanism of the third embodiment 300 when not applying compressive tension to the elastic device component of switch mechanism.
Figure 25:
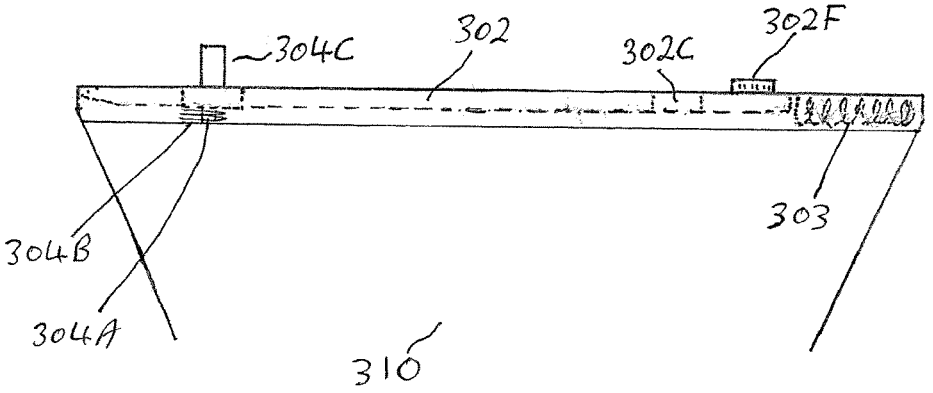
FIG. 25 shows a side view of the shaft in the closed position with other components of the third embodiment.
Figure 27:
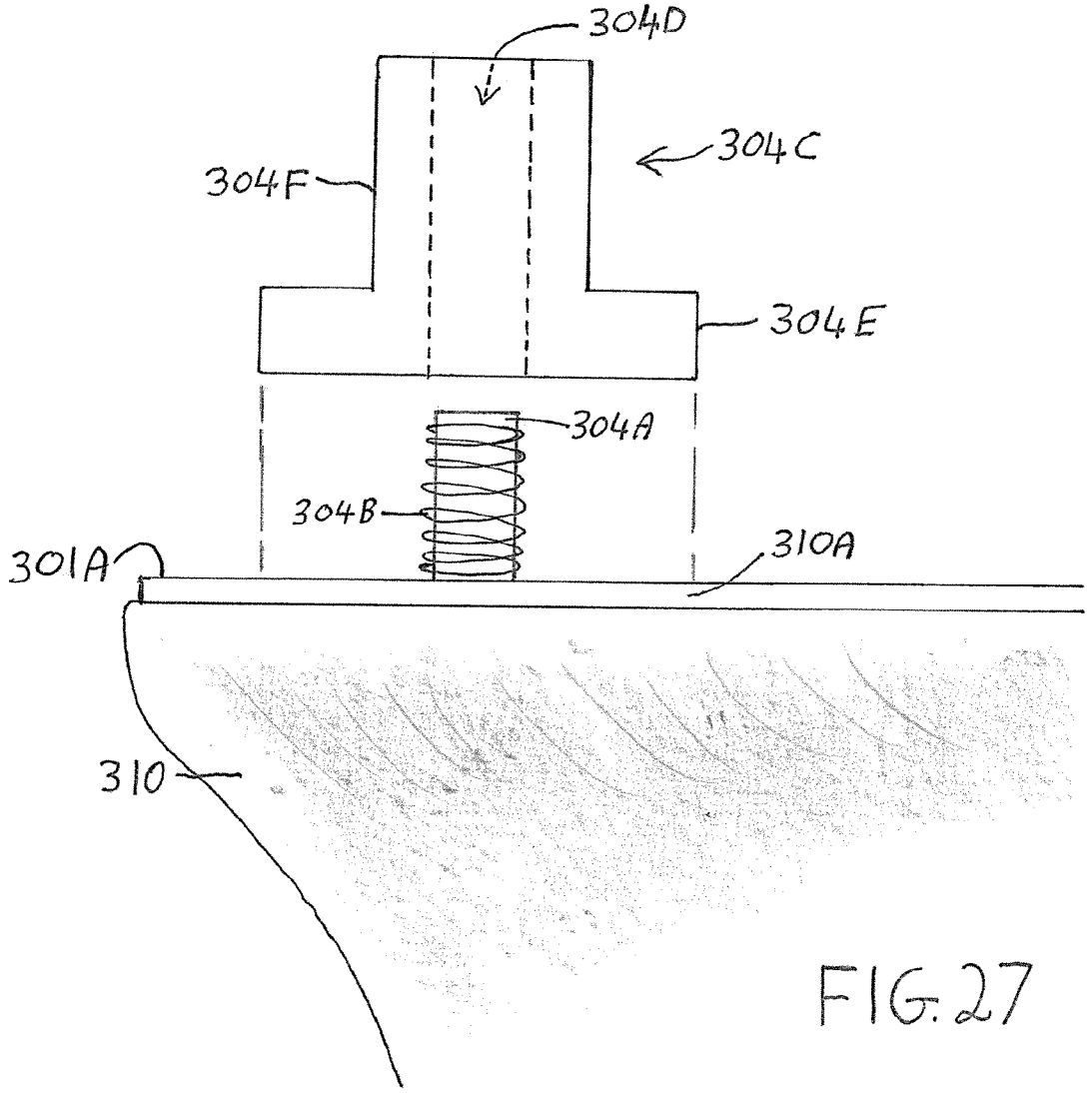
FIG. 27 shows a partial side view of the switch mechanism configured on base portion of chamber.

FIGS. 23, 24 and 27, (and other figures) shows a non-limiting example of how a different type of switch mechanism 304 can be configured in an embodiment, and a different way that a said shaft(s) 302 may be placed into the said open and closed positions when manipulated by user. In this embodiment the switch mechanism 304 is adjacent to the distal end of embodiment 300 as shown in FIGS. 25 and 27.

As shown in FIGS. 23, 24 and 27 (and other figures) the switch mechanism 304 comprises a holding post 304*a*, and an elastic device 304*b*, and a pusher 304*c*. The holding post 304*a* is configured adjacent to the top portion 310*a* of wearable ring portion 310 as shown in FIG. 27. The top portion 310*a* comprises the base portion 301*a* of chamber 301.

The elastic device 304*b* of switch mechanism 304 is configured adjacent to holding post 304*a* (placed around said holding post in this embodiment), and the pusher 304*c* is placed on top of holding post 304*a* and elastic device 304*b*. The pusher 304*c* further comprises a socket portion 304*d* so that pusher 304*c* can freely move up and down holding post 304*a* under spring tension from elastic device 304*b* when manipulated by user.

Figure 30:
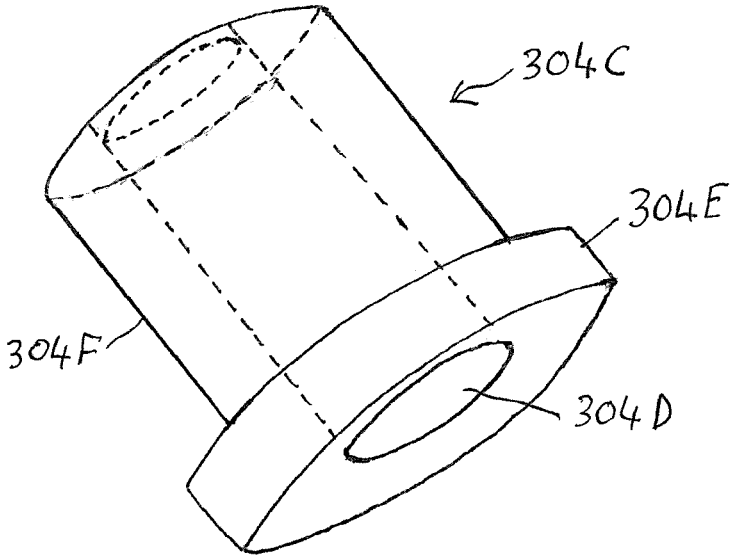
FIG. 30 shows an isometric view of the pusher component of switch mechanism.

The pusher 304*c* also comprises a base portion 304*e* and a post portion 304*f*. As shown in FIG. 25, the elastic device 304*b* applies tension to base portion 304*e* so that base portion 304*e* is pushed upwards, adjacent to, and relatively flush with first socket portion 302*a* of shaft 302 (the closed position). FIG. 30 shows an isometric view of pusher 304*c*.

Shaft

Figure 26:
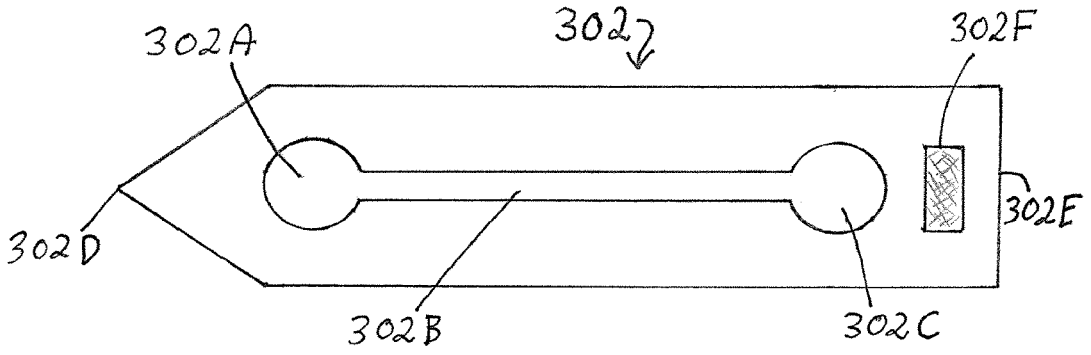
FIG. 26 shows an aerial view of how a shaft can be configured for the third embodiment.

FIG. 26 shows an aerial view of shaft 302 further comprising a first socket portion 302*a*, and a sliding slot 302*b*, and a second socket portion 302*c* and a front portion 302*d* and a rear portion 302*e*, and a push return mechanism 302*f*. It is to be noted that the shaft 302 in this embodiment is substantially flat and comprises no said elastic device or piston as shown in other embodiments of said shafts.

In the said closed position the said compressed elastic device applies spring tension to rear portion 302*e* of shaft 302, but because the base portion 304*e* of pusher 304*c* is flush inside first socket portion 302*a* of shaft 302, this prevents shaft 302 from being forced into the open position under spring tension. A function of the holding post 304*a* is also to supply a rigid formation to resist pressures applied to said components of embodiment 300 during operational use.

When user applies downwards pressure to pusher 304*c*, to compress elastic device 304*b*, the base portion 304*e* of pusher 304*c* is now released from being flush with first socket portion 302*a* of shaft 302. The post portion 304*f* (instead of the base portion 304*e*) is now adjacent with first socket portion 302*a* and sliding slot 302*b* of shaft 302.

The diameter of post portion 304*f* is narrower that the diameter of the first socket portion 302*a* and narrower than the diameter of sliding slot 302*b*, allowing the shaft 302 to be released from closed position to the open position under spring tension from elastic device 303. As shaft 302 is forced from closed position to open position under said spring tension, the sliding slot 302*b* moves around post portion 304*f*.

When user releases downwards pressure on pusher 304*c*, (when shaft 302 is in open position), the elastic device 304*b* forces base portion 304*e* upwards and flush inside second socket portion 302*c* of shaft 302, and this prevents shaft 302 from falling back into the closed position until manipulated by user.

The shaft 302 is also prevented from completely exiting the chamber 301 because the second socket portion 302*c* is locked in position by the combining forces of the holding post 304*a* and the base portion 304*e* of switch mechanism 304, that holds shaft 302 in place so that it can withstand substantial force during normal operation.

It is also to be noted that the shaft 302 is also held in position and prevented from completely exiting the chamber 301 because a function of the cover portion 301*e* of chamber 301 is to assist holding shaft 302 in position.

Chamber

Figure 28:
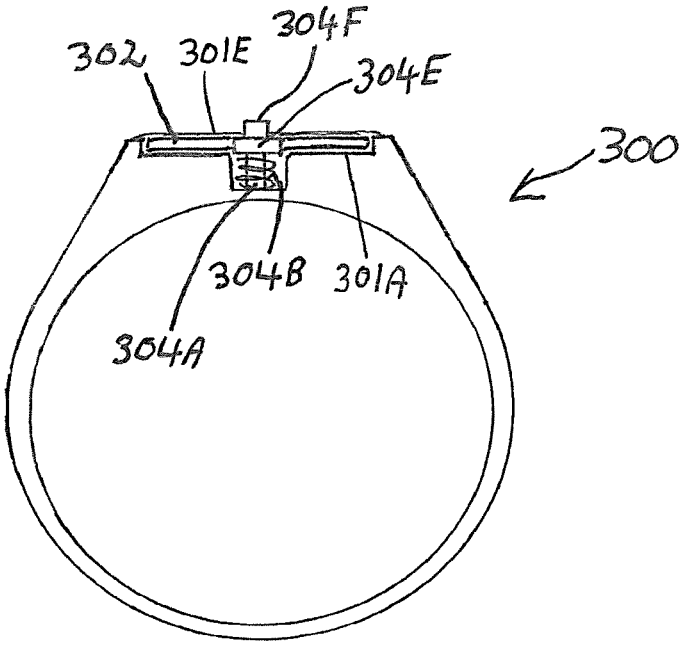
FIG. 28 shows a front view of a wearable ring assembly wherein the pusher component of the switch mechanism is applying compressive tension to the elastic device component of switch mechanism.
Figure 29:
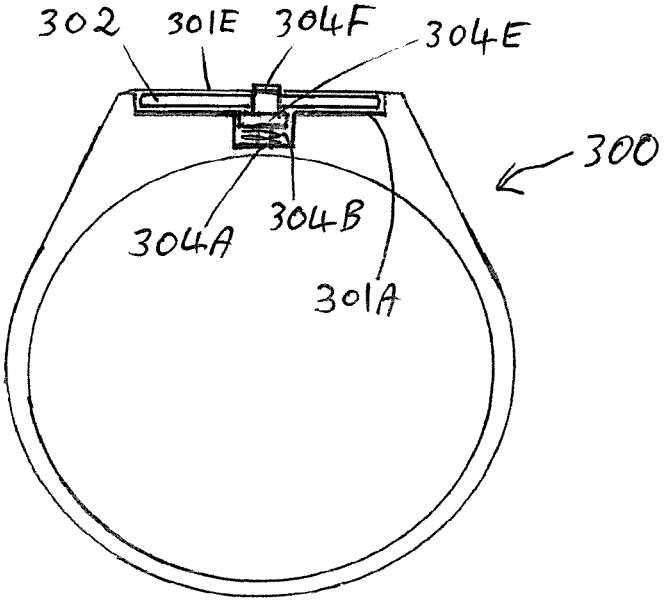
FIG. 29 shows a front view of a wearable ring assembly wherein the pusher component of the switch mechanism is not applying compressive tension to the elastic device component of switch mechanism
Figure 31:
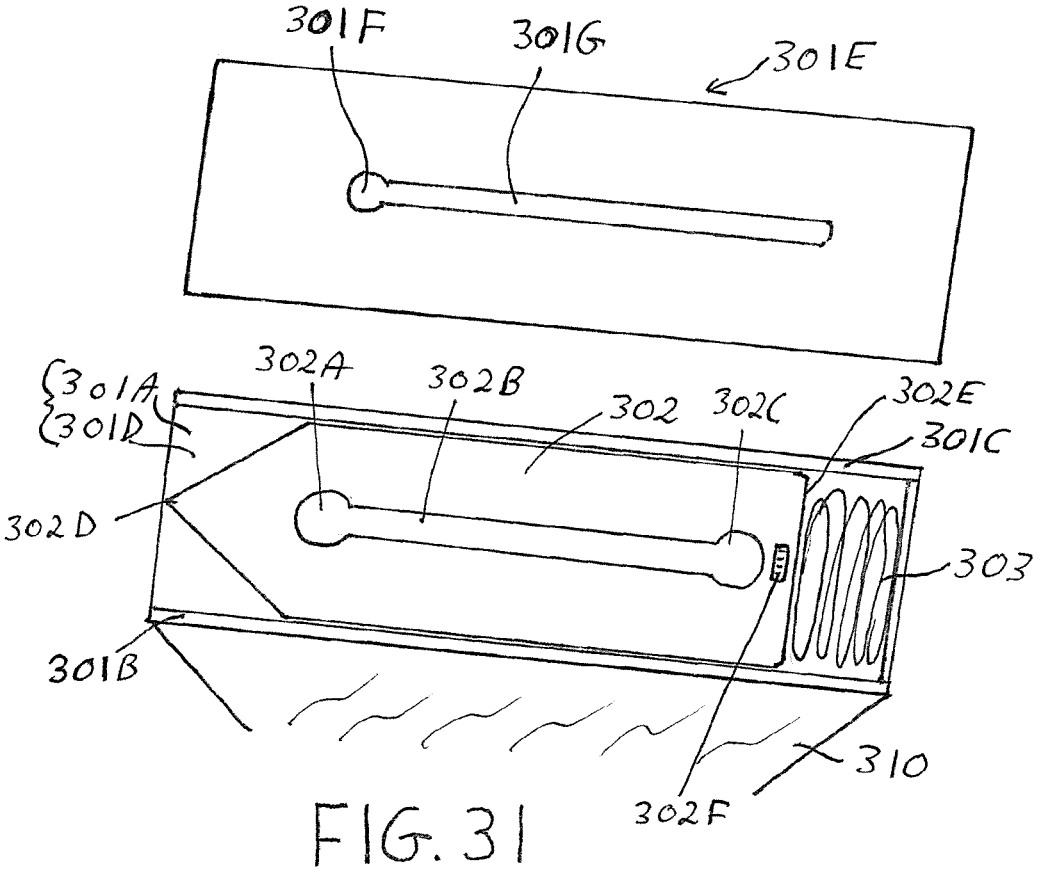
FIG. 31 shows an angled aerial view of the cover portion of the chamber; and an angled aerial view of the shaft and the elastic device configured on the base portion of chamber.

As shown in FIGS. 27, 28, 29, the chamber 301 comprises a base portion 301*a* and a cover portion 301*e* (FIG. 31). As shown in FIG. 31 the base portion 301*a* further comprises a first guide rail 301*b* and a second guide rail 301*c*, and a substantially flat portion 301*d*, and is configured in the top portion 310*a* (FIG. 27) of wearable ring portion 310. The cover portion 301*e* further comprises a socket portion 301*f* and a slide return portion 301*g*.

In other embodiments as an alternative, the guide rails 301*b* and 301*c* may be configured as a component of cover portion 301*e*.

A function of the guide rails 301*b* and 301*c* is to also assist holding shaft 302 in position as shaft 302 moves back and forth through said bore of chamber 301. FIG. 31 shows a non limiting example of an embodiment of a cover portion 301*e*.

Although not shown, the cover portion 301*e* may be connected to base portion 301*a* by soldering the said components together, or riveting the said components together; a processes that is well known in the art. Or the said components may be releasably connected together through another means such as but not limited to screws releasably connecting cover portion 301*e* to base portion 301*a*. Other said components such as the shaft 302, elastic device 303, and the switch mechanism 304, may be configured in position before said connection process of said chamber components.

Another function of the cover portion 301*e* is to assist holding the pusher 304*c* in place to prevent it from dislodging. The spring tension from elastic device 304*b* forces pusher 304*c* upwards but the diameter of socket portion 301*f* of cover portion 301*e* is wider than the diameter of post portion 304*f* of pusher 304*c*, so that post portion 304*f* passes through socket portion 301*f*. But the diameter of socket portion 301*f* of cover portion 301*e* is narrow than the diameter of base portion 304*e* of pusher 304*c*, preventing dislodgment.

The cover portion 301*e* also frictionally engages the shaft 304 enough to assist holding it securely in place, but not too forcefully to prevent movement of shaft 304 when manipulated by user.

The socket slide portion 301*g* of cover portion 301*e* is adjacent to push return mechanism 302*f* of shaft 302 so that push return mechanism 302*f* moves freely back and forth through socket slide portion 301*g* into the open and closed positions when manipulated by user.

Operation/Function

Much of the operation/function of embodiment 300 has been explained but when shaft 302 is in the said closed position, user applies downwards pressure to pusher 304*c* of switch mechanism 304 and the spring tension from elastic device 303 drives the shaft 302 towards distal and end of chamber 301 and into the said open position where it is locked in as explained.

When a user wants to return shaft 302 to the said closed position, user applies downwards pressure to pusher 304*c* of switch mechanism 304 to release the shaft 302; while simultaneously placing a finger(s) on the push return mechanism 302*f*. The user then applies pressure to drag the push return mechanism 302*f* to return shaft 302 to proximal end in the closed position. When shaft 302 is in the closed position, said components of the switch mechanism 304 locks the shaft 302 until released by user.

Alternatives

In an alternative or variation of embodiment 300 the switch mechanism 304 is adjacent to the proximal end of the embodiment 300 and said switch mechanism is configured as a component of said shaft(s).

Other Embodiments

It is to be noted that other embodiments, alternatives and variations of the said embodiments and other possible embodiments not explicitly outlined, may be configured without a said elastic device(s) to assist in placing said shaft(s) in the said open and closed positions. Alternatively a user can use a finger(s) or a simple tool as the assisted opening and closing mechanism to place said shaft(s) into the open and closed positions. Said shaft(s) and said switch mechanisms may still comprise said elastic device(s) but these alternative embodiments do not require a said elastic device(s) to assist the opening and closing of the said shaft(s) in the sense of applying spring tension to force said shaft(s) into the open and/or closed positions. Shaft (s) may comprise one or more elastic devices.

In other embodiments the said shaft(s) can be configured to eject a projectile(s) that completely leaves the said chamber(s).

Clarification of Terminology and Components

For clarification it is to be noted that the term 'distal end' refers to the portion of an embodiment, variation and alternative, where the said shaft(s) protrudes from the said chamber(s) and is placed in the open position. It is also to be noted that the term "proximal end" refers to the portion of an embodiment, variation and alternative, where the said shaft(s) is enclosed fully or partially (depending on the embodiment, variation and alternative) in the said chamber(s) and is placed in the closed position.

In other embodiments, variations and alternatives, the open position of the shaft (s) may be at a different angle to out the front open position of shaft (s) as already shown in some embodiments and figures. In a non limiting example a torsion spring may be configured to release shaft (s) on angle or in a 180 degrees movement rather than straight out the front in the said open position. In other embodiments, alternatives and variations shaft (s) may be placed into open and closed position in any angle and any direction depending on configuration.

It is to be noted that the said bore (s) is a hollow cavity portion for shaft(s) to move back and forth or at any other angle to be placed in the said open and closed positions.

Elastic Devices

It is to be known that the term 'elastic device' refers to any device made of any suitable material that will return to its original shape when stretched. A non-limiting example is any type of spring that is suitable for use as an elastic device; any type of spring clip configuration, a spring with a lever configuration, and any elastomer. One skilled in the art could configure an elastomer such as a rubber band, and other suitable flexible devices for use as an elastic device.

It is to be noted that many different types of springs such as, but not limited to torsion springs, compression springs, constant force springs, tension springs, wire form springs, wire springs, springs with levers, other types of springs and any combination thereof can be configured for use in the embodiments, variations and alternatives as elastic devices. It is to be understood that an elastic device is a type of tensioning mechanism.

The configuration of a embodiment, alternative and variation, will determine the number, type and position of said elastic devices configured within the embodiment, alternative and variation.

Using said embodiment 100 as a non-limiting example of a variation or alternative: although embodiment 100 comprises one compression spring as the elastic device 103, one skilled in the art could configure other springs, spring assemblies or other suitable types of said elastic device(s) to supply tension to force one or more said shaft(s) into the said open and closed position(s).

For example, alternatives to a torsion spring may be a wire form spring, a flat spring, a leaf spring, a constant force spring, a coil spring, a compression spring, a tension spring or any other commonly available spring or custom made spring that may be configured to supply said spring tension.

Those skilled in the art will also understand that an alternative type of said elastic device(s) used in a said embodiment, may mean that some components of the embodiment may need to be re-configured to allow configuration of alternative type of elastic device(s).

Shafts

It is to be noted that said shaft(s) in the said embodiments, and variations and alternatives can be any shape, size, dimension and configuration as required. Some shaft(s) may comprise said elastic devices, pistons, and other said components; but other shaft(s) may comprise different configurations even if not specifically mentioned. A projectile, pen, tool, refill/cartridge, knife etc are all different types of shafts.

Note that in other embodiments, variations and alternatives elastic device (s) may be used to assist closing not necessarily opening. User may use finger or tool to push shaft(s) into open position and encounter spring resistance before shaft (s) locks in place, but when releasing, the elastic device assists in rapid closure of shaft (s).

Switch Mechanism

It is to be noted that said switch mechanism(s) in the said embodiments, and variations and alternatives can be any shape, size, dimension and configuration as required. Said switch mechanism(s) assists both opening and closing but in different ways and actions as explained in the embodiments, variations and alternatives.

Some configurations of switch mechanism(s), for example, a function of the switch mechanism configured in embodiment 200, is used to apply tension to two elastic devices, one to place shaft (s) into the open position and one to one to place shaft (s) into the closed position as explained. But in some configurations in other embodiments, for example, said switch mechanism(s) applies tension to a single elastic device to place shaft (s) into the open position, and the shaft (s) is manually returned to the closed position by user as explained. A switch mechanism may also be considered to be a trigger mechanism.

It is to be noted that the terms assisted opening and assisted closing, is used to describe the various types of action deployed by a user in conjunction with the relevant components in the embodiments, alternatives and variations of device when placing the shaft (s) of device into the open and closed positions. Some embodiments are configured with actions that may be described as automatic opening and automatic closing. For example, the double action automatic opening and closing of the shaft (s) as described in embodiment 200.

Either way, the terms assisted opening and assisted closing is used to describe the fully automatic configuration as described in embodiment 200, and other embodiments regardless of their configuration. For example an embodiment where an elastic devices is used to place shaft (s) into the open position, but the shaft (s) is manually returned to the closed position by user as explained.

Note that in other embodiments, variations and alternatives elastic device (s) may be used to assist closing not necessarily opening. User may use finger or tool to push shaft(s) into open position and encounter spring resistance before shaft (s) locks in place, but when releasing, the elastic device assists in rapid closure of shaft (s).

Chamber

A chamber is a stabilizing portion that allows the shaft (s) to move back and forth or in any other direction according to the embodiment, and may be many different shapes and dimensions and configurations and number of components. Some chambers may comprise an open portion (from the aerial view), depending on the embodiment. In other embodiments, some chambers may comprise a plurality of components.

Embodiments Materials

It is to be understood that the materials of the said embodiments, alternatives and variations, comprises any known materials and combinations of materials without limitation, such as gold, silver, platinum, rhodium, other precious metals, titanium, tungsten, stainless steel, steel, brass, bronze, tin, aluminium, alloys, any other metals, minerals, glass, wood, plastics, resins, leather, PVC, polypropylene, polycarbonate and the like.

It is also to be understood that the embodiments, variations and alternatives can be manufactured with any configuration such as cosmetic appearance, shape, style, size, and dimension without departing from the general inventive concept as described and as defined in the detailed description and claims.

Other Uses of the Embodiments, Variations and Alternatives

Recreation and Therapy

Other non-limiting uses of the said embodiments, variations and alternatives includes uses for and methods of relaxation or therapy; use as a toy; an educational tool; and an amusement device. The back and forth movement, and any other angles and direction of movement of the shaft(s) under tension, can be a form of relaxation and therapy, a type of toy and also amusement, as users often enjoy fiddling with devices and apparatus. The back and forth movement, and any other angles and direction of movement of shaft(s) under tension, can also be used as an educational tool to demonstrate how elastic devices and other components operate.

Other embodiments, alternatives and variations of a device with a assisted opening and closing mechanism comprises: knives, biros, nail files, tools, screw drivers, etc.

It is to be noted that the embodiments, variations and alternatives of the device may be modified to become a hand held automatic knife. This I done by enlarging the components and removing the wearable shank portion of the ring that goes around a finger. Other cosmetic modifications will be necessary but will not stray from the scope of the invention.

CONCLUSIONS, RAMIFICATIONS, AND SCOPE

Each of the said components of the embodiments of the invention can be expressed in a plurality of alternatives, variations and configurations, without departing from the scope of the invention. This is because of the customizable nature of the embodiments and the various types of jewelry items and other items that the embodiments comprise. Jewelry items like rings, and other said items such as knives, comprising the embodiments, can be expressed in many different styles, shapes and dimensions and the embodiments may need to be configured with various variations and alternatives to meet those needs.

It is to be noted that where the various embodiments and alternatives, variations, examples and configurations of the invention is outlined, that all of the details of each of the said embodiments and alternatives, variations, examples and configurations, may be applicable to every other embodiment, alternatives, variations, examples and configurations, even if not specifically mentioned. They may also be applicable to other embodiments, variations and alternatives in keeping within the scope of the invention, even though not revealed within this disclosure that may be conceived at a later time.

In addition, while a particular feature of the invention may have been disclosed with respect to only one of several embodiments, alternatives, and variations, such features may be combined with one or more other features of the other embodiments, alternatives, variations, as may be desired and advantageous for any given or particular application.

Although the invention has been shown and described with respect to certain embodiments, variations and alternatives, it is obvious that equivalent alterations and modifications will occur to others skilled in the art upon the reading and understanding of this specification and the annexed drawings.

In particular regard to the various operations/functions performed by the above described components the terms, (including a reference to a "function" and "operation") used to describe components, are intended to correspond, unless otherwise indicated, to any component which performs the specified operation/function of the described component (i.e. that is functionally equivalent), even though not structurally equivalent to the disclosed structure which performs the operation/function in the herein illustrated exemplary embodiments of the invention.

Furthermore, to the extent that the terms "including", "includes", "having", "has", "with", or variants thereof that are used in either the detailed description and the claims, such terms are intended to be inclusive in a similar manner to the term "comprising."

What is claimed is:

1. A wearable device comprising:

a chamber with a front end and a back end, the chamber having a shaft-receiving space and an opening into the space through the front end, and an opening into the space through the back end, and;

a shaft, longitudinally slidable in the chamber between a closed position in which the shaft is received in the chamber and an open position in which the shaft extends through said opening at the front end, a portion of the shaft when in the open position, remains within the chamber, and;

a first spring longitudinally movable within the chamber and configured adjacent to the back portion of the shaft and a second spring longitudinally movable within the chamber and configured adjacent to the front portion of the shaft, and;

a switch mechanism operable when the shaft is in the locked closed position to simultaneously compress the first spring and unlock the shaft to thereby drive the shaft from the locked closed position to the locked open position, and when the shaft is in the locked open position to simultaneously compress the second spring and unlock the shaft to thereby drive the shaft from the locked open position to the locked closed position.

2. The wearable device of claim 1, wherein the switch mechanism comprises a first portion and a substantially cylindrical second portion, the first portion is longitudinally slidable and further comprises a plurality of angled portions to frictionally engage the second portion, and a first pushing portion to compress the first spring and a second pushing portion to compress the second spring.

3. The wearable device of claim 1, wherein the switch mechanism further comprises one or more pushing portions.

4. The wearable device of claim 1, wherein the shaft is substantially cylindrical comprising a cavity portion, a bore portion and further comprising a spring and a longitudinally slidable piston configured inside the bore portion.

5. The wearable device of claim 1, wherein the chamber further comprises a first holding cavity configured adjacent to the back end of the chamber and a second holding cavity configured adjacent to the front end of the chamber.

6. The wearable device of claim 1, wherein the chamber's shaft-receiving space is substantially cylindrical.

7. The wearable device of claim 1, wherein the chamber's shaft-receiving space is substantially rectangular.

8. The wearable device of claim 1, wherein the shaft is a substantially flat blade comprising a spring.

9. The wearable device of claim 1, wherein the wearable device further comprises one or more additional springs configured adjacent to the switch mechanism to assist the operable movement and stability of the switch mechanism.

10. The wearable device of claim 1, wherein the shaft further comprises one or more springs.

11. The wearable device of claim 1, wherein the wearable device further comprises an additional chamber and an additional shaft received in the chamber, configured adjacent to said chamber with a front end and a back end.

12. The wearable device of claim 1, wherein the wearable device is a ring.

13. The wearable device of claim 1, wherein the wearable device is a knife.

14. The wearable device of claim 1, wherein the wearable device is used as a therapeutic aid.

15. A wearable device comprising:

a chamber with a front end and a back end, the chamber having a substantially cylindrical shaft-receiving space and an opening into the space through the front end, and an opening into the space through the back end, and;

a substantially cylindrical shaft narrower at the front portion and wider at the back portion, longitudinally slidable in the chamber between a closed position in which the shaft is received in the chamber and an open position in which the shaft extends through said opening at the front end, a portion of the shaft when in the open position, remains within the chamber, the shaft comprises a cavity, an internal bore, a piston and a spring, and;

a first spring longitudinally movable within the chamber and configured adjacent to the back portion of the shaft and a second spring longitudinally movable within the chamber and configured adjacent to the narrower front portion of the shaft, and;

a switch mechanism operable when the shaft is in the locked closed position to simultaneously compress the first spring and unlock the shaft to thereby drive the shaft from the closed position to the locked open position, and when the shaft is in the locked open position to simultaneously compress the second spring and unlock the shaft to thereby drive the shaft from the locked open position to the locked closed position.

16. The wearable device of claim 15, wherein the wearable device further comprises one or more additional springs configured adjacent to the switch mechanism to assist the operable movement and stability of the switch mechanism.

17. The wearable device of claim 15, wherein the wearable device is a ring.

18. The wearable device of claim 15, wherein the wearable device is a knife.

19. The wearable device of claim 15, wherein the wearable device is used as a therapeutic aid.

* * * * *